United States Patent [19]

Bauer

[11] Patent Number: 5,016,764

[45] Date of Patent: May 21, 1991

[54] MERCHANDISE DISPLAY UNIT

[75] Inventor: Jamie D. Bauer, New Providence, N.J.

[73] Assignee: Scholl, Inc., Memphis, Tenn.

[21] Appl. No.: 436,305

[22] Filed: Nov. 13, 1989

[51] Int. Cl.[5] ..... A47B 47/00

[52] U.S. Cl. ..... 211/189; 248/57; 248/222.2

[58] Field of Search ..... 248/222.3, 222.2, 222.4, 248/223.2, 909, 906, 57, 215; 403/381, 353, 253, 254, 255; 211/189, 190; 312/257

[56] References Cited

U.S. PATENT DOCUMENTS

| | | | |
|---|---|---|---|
| 2,369,930 | 2/1945 | Wagner, Sr. | 403/381 X |
| 2,380,155 | 7/1945 | Divine | 248/57 |
| 3,334,461 | 8/1967 | York | 248/57 X |
| 3,874,804 | 4/1975 | Siegal | 403/381 X |
| 4,206,955 | 6/1980 | Cooper | 248/222.2 X |
| 4,323,163 | 4/1982 | Johns | 211/189 |
| 4,389,133 | 6/1983 | Oberst | 248/222.4 X |
| 4,434,900 | 3/1984 | Cook | 211/189 |
| 4,441,768 | 4/1984 | Clarkson | 312/257.1 |
| 4,508,231 | 4/1985 | Honickman | 211/189 X |
| 4,688,687 | 8/1987 | Pryor | 211/189 |

FOREIGN PATENT DOCUMENTS

| | | | |
|---|---|---|---|
| 0230947 | 2/1944 | Switzerland | 403/381 |
| 2041146 | 9/1980 | United Kingdom | 403/381 |

*Primary Examiner*—David L. Talbott
*Assistant Examiner*—Daniel Hulseberg
*Attorney, Agent, or Firm*—Darby & Darby

[57] ABSTRACT

Merchandise display unit including vertical parallel panels arranged in side by side facing relation along a lateral display area, such that the panels extend crosswise thereof and the facing sides of a given pair of adjacent panels define a display space therebetween, each facing side having a lattice of side by side vertical rows of horizontal tiers of panel joint formations, e.g. grooves, correspondingly arranged for coaction with those of the lattice of the other facing side to form a plurality of facing cooperating pairs of panel joint formations in the display space, and crossbars for mounting merchandise display elements thereon in a given display space, the crossbar ends having an opposed pair of crossbar joint formations, e.g. tongues, mating with each facing cooperating pair of panel joint formations to form opposed joints. A crossbar can be mounted between adjacent panels at the location of any facing cooperating pair of panel joint formations thereon and will interlock the panels via the joints.

24 Claims, 7 Drawing Sheets

Fig. 6.
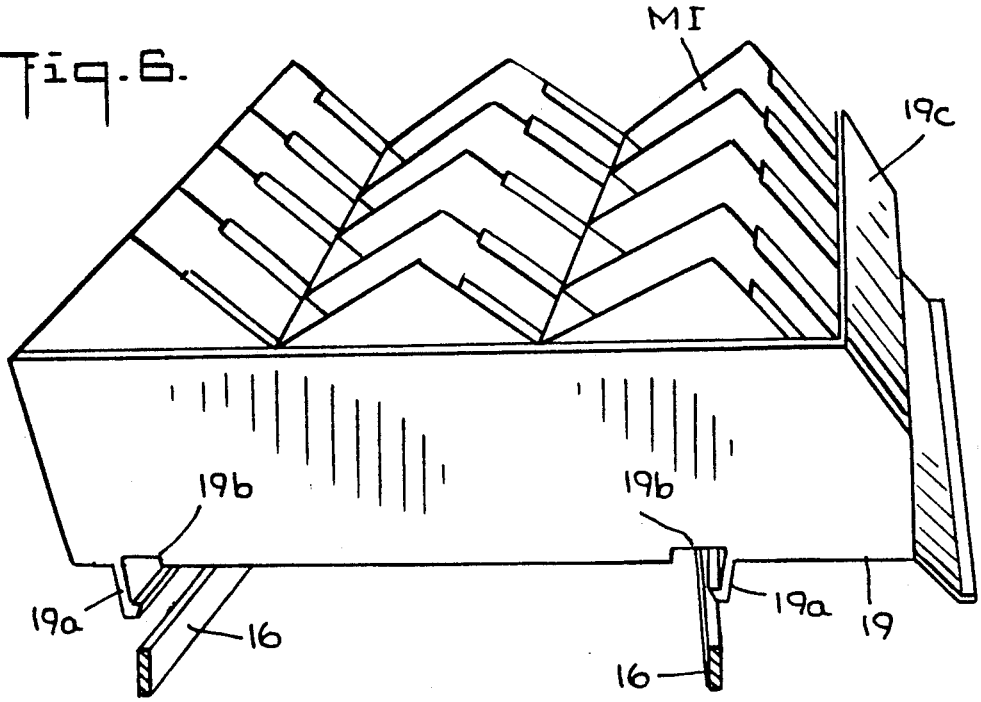
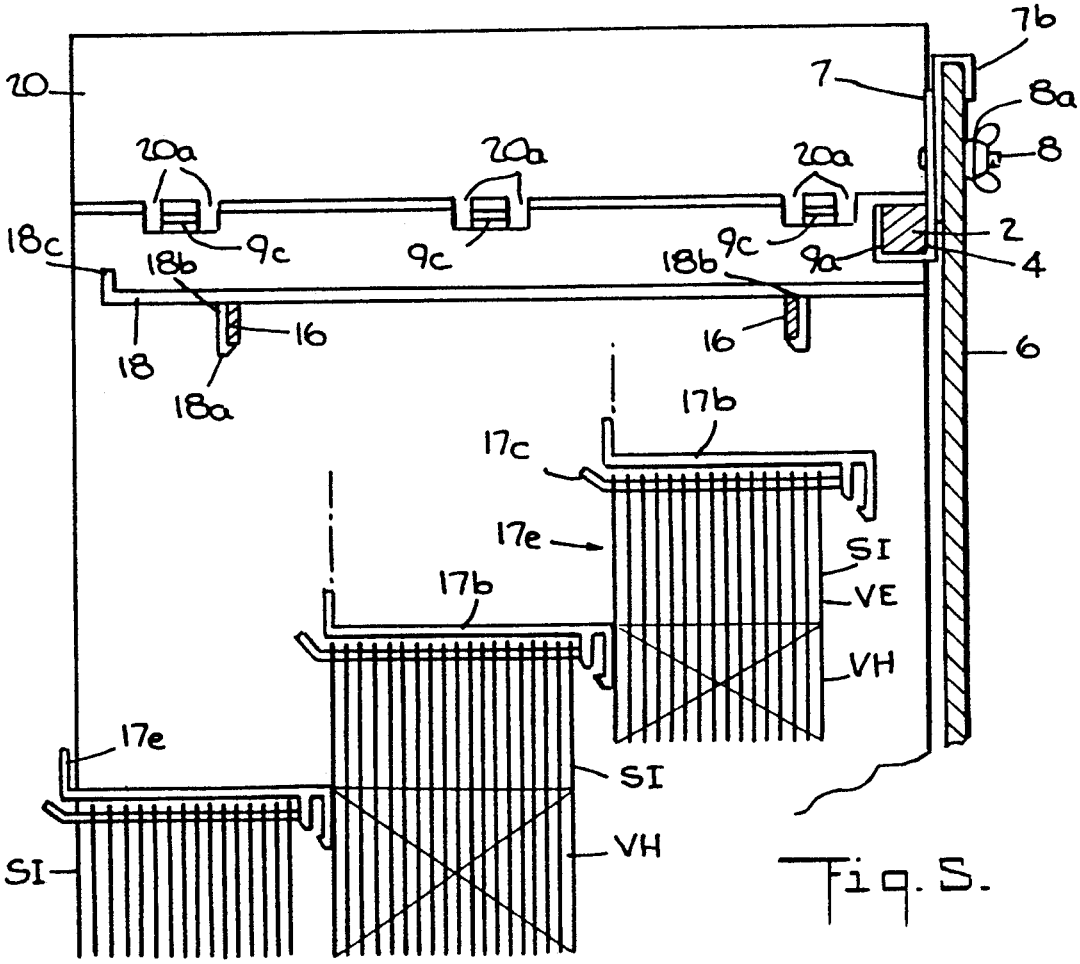
Fig. 5.

9
BREAK OFF
BREAK OFF
9f
9a
H
9h
9g
9b
9i
9d
9e
9c
25
24
23
22a
22b
10
21
C
9j

L
C
16
30
31
32
33
9
9i
9j
10a
10b
21a
21b
21d
22a
22b
23b
24a
24b
25a
25b
G
H

MERCHANDISE DISPLAY UNIT

FIELD AND BACKGROUND OF THE INVENTION

The present invention relates to a merchandise display unit, and more particularly to a such a unit having vertical parallel panels in facing relation along a lateral display area and extending crosswise to the area, with their facing sides forming display spaces, each facing side having a lattice of joint formations for coaction with those of the other facing side lattice, and crossbars with joint formations on their ends mating with those on the panels to mount the crossbars between and interlock adjacent panels for maximized display space use.

The usual merchandise display unit has a back wall with a grid of equally spaced holes in vertical rows of horizontal tiers forming a pegboard for attaching cantilever peghooks or like elements carrying merchandise items for display and access by consumers in retail stores. It is important in such stores, e.g. drug stores, supermarkets, etc., that the unit use efficiently the lateral display area, i.e. the lateral or horizontal width along the store aisle, to hold as many items as possible.

The display area typically has a lateral or horizontal width along the aisle of 36 to 72 inches, a depth crosswise of the lateral aisle of 12 to 18 inches, and a height of 48 to 72 inches. The pegboard unit is often provided with long, e.g. 12 inch, cantilever peghooks to store more items along the depth of the area, but this subjects the pegboard to structural failure under the weight of items carried on the peghooks.

The unilateral cantilever support of the peghooks on the pegboard and use of equally spaced holes preclude positioning of the peghooks in the display area so as to arrange the items thereon at any and all locations relative to both the lateral direction and crosswise or depth direction of the area.

A pegboard unit drawback is that the holes must be spaced to leave enough material therebetween for structural integrity, or else the pegboard will collapse and/or tear at the holes under the weight of peghook carried items. Thus, besides precluding infinite lateral adjustment of the items, the adjustment is limited by the required minimum hole interval.

Although maximum use in a retail store of the lateral or horizontal width of the display area, and thus of the pegboard unit, is generally of primary concern, its vertical height is usually less important because this is limited by the range of reach of the consumer, which is normally less than the usable store height, and because the vertical density of use of the unit is subject to wide variation in the size of items on the peghooks, some vertically spanning several horizontal tiers.

While a maximum number of side by side peghooks might fit on a horizontal tier of holes, maximum lateral or horizontal density usage is usually not possible, as the merchandise item width is normally greater than the peghook width. Thus, extra lateral spacing is needed to avoid interfering overlap of items on adjacent peghooks, but this can only be provided within the pegboard hole interval adjustment range.

Space for a merchandise display unit in a retail store is calculated primarily on the basis of width along the aisle, and secondarily height, but not on the basis of depth as this dimension is generally common to all space along the aisle. Thus, given the lateral adjustment interval limitations of the pegboard unit, the more usage that can be made of the 12 to 18 inch display area depth, the more economical the unit will be.

To enhance use of the display area depth, the pegboard unit may have a cantilever auxiliary mounting member, e.g. a horizontal wire or round rod, hooked to the pegboard and extending forwardly, e.g. 6 inches, to carry, e.g. 12 inch, peghooks extending forwardly to fill the full 18 inch display area depth. By using an auxiliary member with 6 and/or 12 inch peghooks in other horizontal tiers, the items can be arrayed in a wider variety of arrangements, e.g. in alternate horizontal tiers in "waterfall" display.

However, using such an auxiliary member does not avoid the basic pegboard unit limitations as to incremental adjustment and ability to withstand the weight of items carried on the cantilever peghooks and auxiliary members without structural failure, and thus they cannot be positioned in the display area so as to permit versatile arrangement of the items thereon at any and all locations relative to both the lateral direction and crosswise or depth direction of the area.

It is clear from the above that a need exists for an improved merchandise display unit to overcome these drawbacks.

SUMMARY OF THE INVENTION

It is an object of this invention to overcome prior art drawbacks, and to provide a merchandise display unit having side panels instead of a rear pegboard, comprised as lattice panels arranged in vertical parallel facing relation along a lateral display area and crosswise to the area to form display spaces between adjacent panels, plus crossbars mountable between adjacent panels in any number of spatial positions to hold display elements such as cantilever peghooks carrying merchandise items, at maximum use of the area without the usual structural failure problems under the item load conditions.

It is another object of this invention to provide such a unit which is simple and inexpensive in construction, readily fabricated, easily erected by unskilled workers, and robust and long wearing in use, for an unlimited variety of adjustments with respect to the size, shape and quantity of merchandise items displayed, all without using a lateral pegboard.

According to this invention, a merchandise display unit is provided which comprises an arrangement of a plurality of generally vertical parallel panels in side by side facing relation along a lateral display area, such that the panels extend crosswise thereof and the facing sides of a given pair of adjacent panels define a display space therebetween, and at least one crossbar to mount one or more merchandise display elements thereon in the display space between the pair of adjacent panels for carrying merchandise items thereat.

Each facing side of the pair of panels has a modular lattice of side by side generally vertical rows of horizontal tiers of panel joint formations correspondingly arranged for coaction with those of the other to form a plurality of facing cooperating pairs of such formations in the display space.

Each crossbar has opposed ends with an opposed pair of counterpart crossbar joint formations mating, e.g. overlappingly, with each facing cooperating pair of panel joint formations and forming a pair of opposed locking joints therewith. In this way, a crossbar can be mounted removably between a pair of adjacent panels at the location of any facing cooperating pair of panel joint formations thereon in the display space and will thereby also interlock laterally such panels via the opposed joints.

Each crossbar may be a generally vertical strip, i.e. a strip lying in a vertical plane with the strip axis extending horizontally, having a pair of opposed corresponding vertical parallel flanges on its ends, one flange extending in one crosswise direction away from the crossbar and the other flange extending in the opposite crosswise direction away from the crossbar, with the opposed pair of the crossbar joint formations located on the outermost faces of the flanges. Favorably, each flange has an end cap and the crossbar joint formations are disposed on the end caps.

The corresponding crossbar and panel joint formations are desirably mating, especially dovetail, tongues and grooves.

In particular, the panel formations include grooves recessed laterally in the facing sides of adjacent panels, so that each groove in the facing side of one panel is in offset relation in crosswise direction to the lateral direction to the corresponding cooperating groove in the same tier of the same row in the other panel facing side, and the crossbar formations include tongue overlapping laterally with the grooves.

A lateral clearance recess is located in the facing side of each panel in offset relation in crosswise direction to each groove on that side and in alignment in lateral direction with the corresponding cooperating groove in the same tier of the same row in the facing side of the other panel, to permit movement of the corresponding tongues in relative crosswise direction to mate the tongues with the corresponding facing cooperating pair of grooves, so as to form the opposed joints.

Preferably, at least three panels and a plurality of crossbars are provided, with one panel common to two adjacent display spaces and having a lattice of vertical rows of horizontal tiers of the grooves in each of its opposed sides, each row on one side being offset in crosswise direction relative to the same corresponding row on the opposed side, so that the grooves occupy substantially completely the common panel thickness with the grooves in one side being immediately laterally adjacent and in horizontal alignment with, and concordantly offset in crosswise direction relative to, the corresponding opposed grooves respectively in the opposed side.

The grooves and tongues may thus be arranged to permit in line lateral positioning of one crossbar with its tongues in one facing cooperating pair of panel grooves at a given tier of one corresponding row of a given pair of adjacent panels, including the common panel, in one of the two adjacent display spaces, and another crossbar with its tongues in the same corresponding facing cooperating pair of panel grooves at the same tier in the same row of the next adjacent pair of adjacent panels, including the same corresponding but offset row in the common panel, in the other of the two adjacent display spaces.

The unit may include a generally vertical laterally extending frame disposed along the display area, and connectors to mount removably the panels on the frame in desired arangement. Each connector may include a keyhole slot and a separate cooperating stud engageable therein, one of which is located on the given panel and the other on the frame, the keyhole slot and stud being arranged to mount the panel on the frame in hanging cantilever manner. The connector may include a clip suitably mounted on the panel and having a generally vertical and laterally offset wing containing the keyhole slot, with the stud rigidly mounted on the frame to receive the keyhole slot.

A plurality of merchandise display elements may be provided which are mountable on the crossbars, such as peghook elements, each having an attachment portion to attach the element to a corresponding crossbar, and tray elements.

The panel is favorably a one piece plastic structure.

BRIEF DESCRIPTION OF THE DRAWINGS

Other objects of the invention will become apparent from the within specification and accompanying drawings, in which:

FIG. 5 is a sectional view of part of the unit showing the manner in which the crossbars and their merchandise display elements may be positioned relative to the panels;

FIG. 6 is a perspective view of a merchandise display element tray which may be mounted on the crossbars;

DESCRIPTION OF THE PREFERRED EMBODIMENTS

Figure 1:
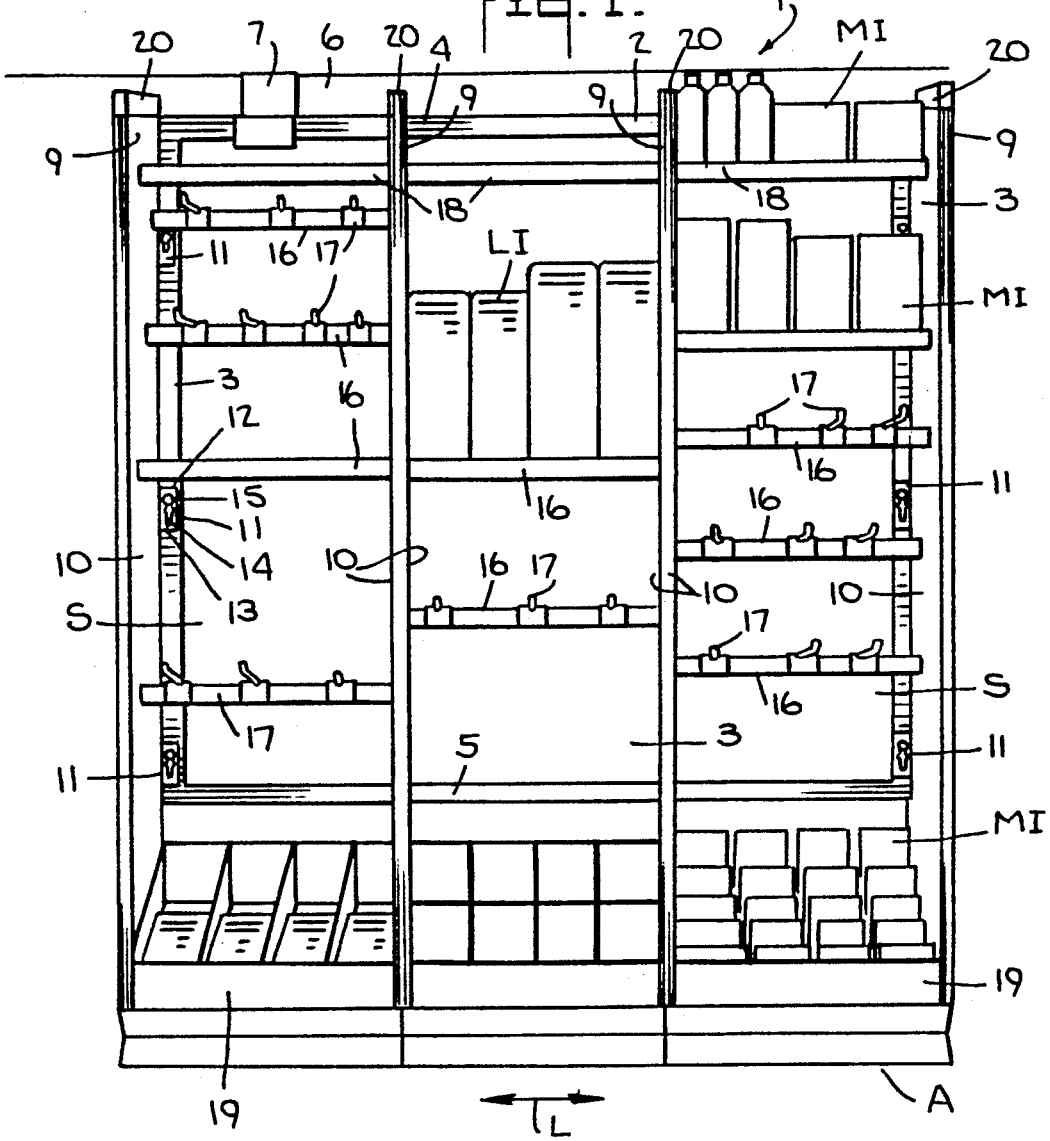
FIG. 1 is a schematic perspective view of a merchandise display unit according to the invention.

Referring to the drawings, and initially to FIG. 1, a merchandise display unit 1 is shown, which includes a vertical frame 2, e.g. of metal tubing, extending in lateral direction L along a lateral display area A, e.g. longitudinally along an aisle of a retail store such as a supermarket, of suitable width, e.g. 36, 48 or 72 inches, and having a plurality of appropriately spaced vertical struts 3 connected, e.g. welded, to top and bottom horizontal beams 4 and 5 to form a rigid integral structure.

Figure 2:
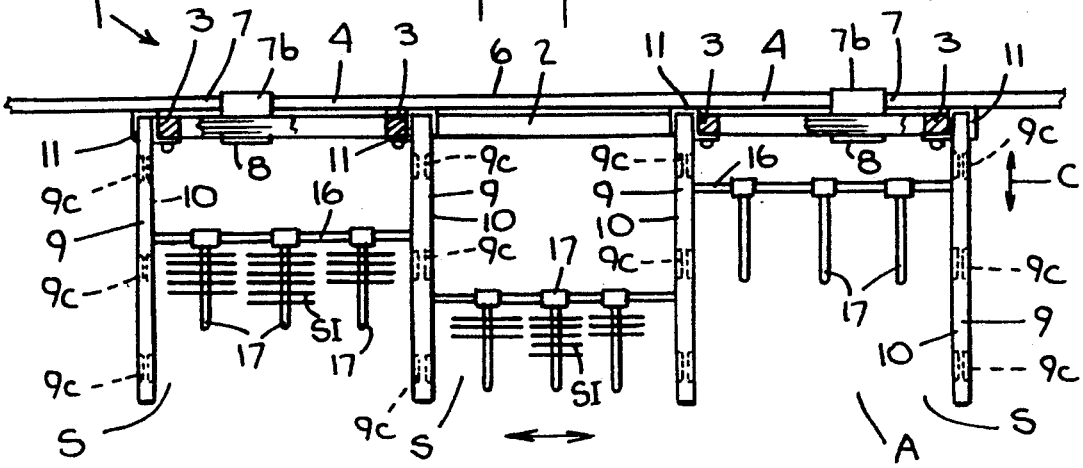
FIG. 2 is a top view of the unit of FIG. 1.
Figure 3:
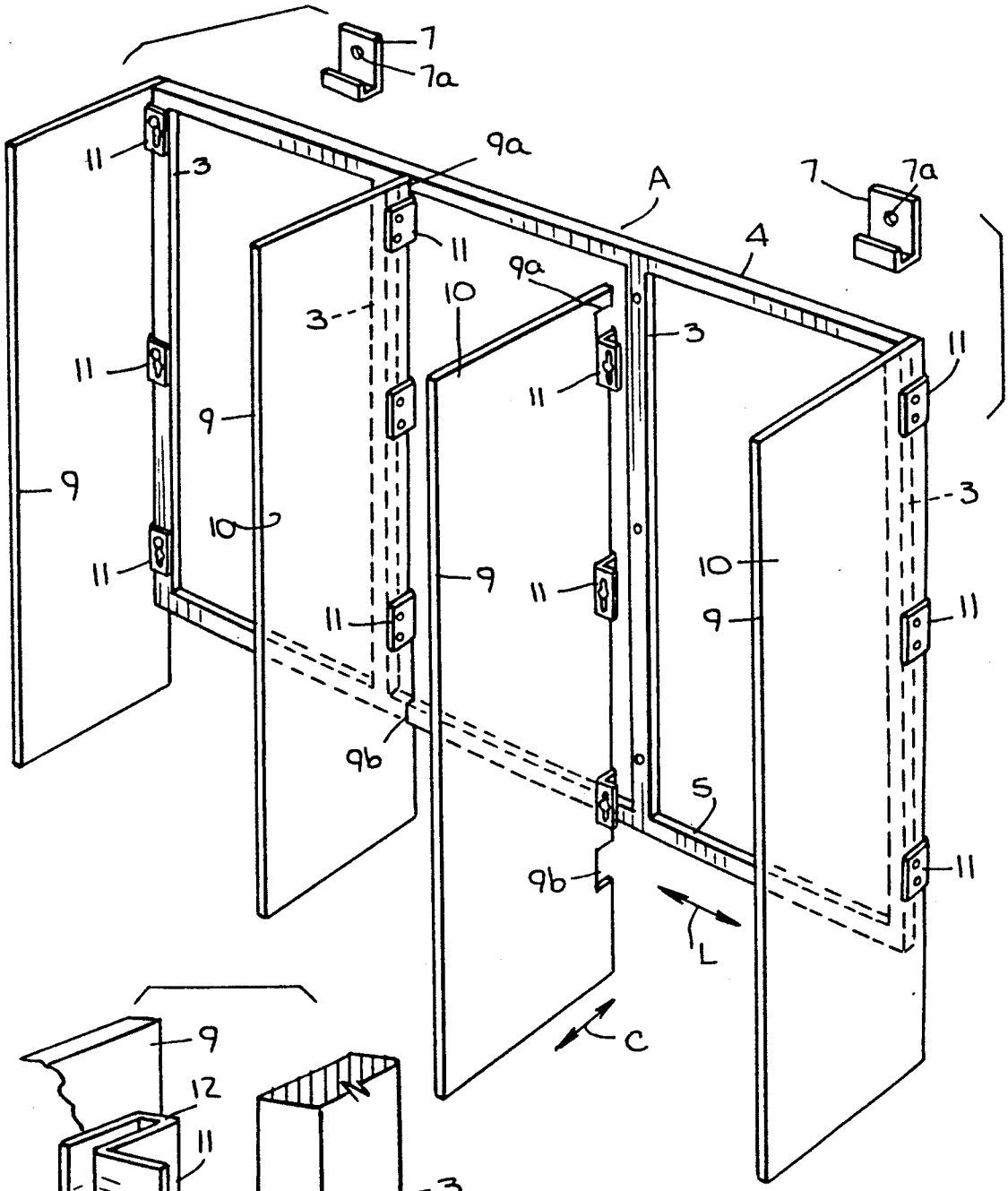
FIG. 3 is a perspective view showing the manner of mounting the panels on the wall frame of the unit of FIG. 1.

Frame 2 is readily mounted on an existing vertical wall 6 in display area A, e.g. one forming an in-store gondola support located along a supermarket aisle, by a pair of J-shaped straps 7 or the like arranged to grip the underside of top beam 4 and having holes 7*a* to fasten straps 7 to wall 6 via bolts 8 and wing nuts 8*a* (FIGS. 2, 3 and 5). Straps 7 may have a top hook clamp portion 7*b* to grip the top edge of wall 6 (FIG. 5).

Alternatively, frame 2 may be made self-standing, e.g. by telescopingly inserting vertical legs of horizontal support members (not shown) in openings in bottom beam 5 in registry with tubing struts 3 to rest frame 2 on the floor, and tightening thumbscrews or the like in holes in the struts against the respective vertical legs at a common telescoping height.

A like plurality of correspondingly spaced vertical parallel panels 9 is arranged in side by side facing relation along lateral display area A, so that they extend in crosswise or transverse direction C (FIG. 2), and in effect perpendicular to frame 2, with the facing sides 10 of each pair of adjacent panels 9 defining a display space S therebetween extending the full depth of display area A.

Typically, for a lateral direction L overall width of 36 inches, frame 2 may have three unequally spaced struts 3, usable with three correspondingly spaced panels 9, to form two unequal width display spaces S, e.g. of 16 and 20 inches, respectively. For such a width of 48 inches, frame 2 may have four generally equally spaced struts 3, usable with four correspondingly spaced panels 9, to form three generally equal width display spaces S, e.g. of 16 inches each, as shown (FIGS. 1–3). Moreover, for such a width of 72 inches, frame 2 may have six appropriately spaced struts 3, usable with six correspondingly spaced panels 9, to form five corresponding display spaces S of given individual widths.

Of course, other overall widths for display area A and frame 2, other numbers of struts 3 and panels 9, and other individual widths between associated struts 3 and panels 9 to form suitable widths of given display spaces S between adjacent pairs of panels 9, may be used, as desired.

For example, panels 9 may be 12 or 18 inches wide and spaced 16 or 20 inches apart along frame 2, so that each display space S is 16 or 20 inches wide in lateral direction L and 12 or 18 inches deep in crosswise direction C. Thus, in the embodiment shown in FIGS. 1–3, the four panels 9 are preferably about 12 inches wide and, like the four struts 3, are spaced about 16 inches apart along frame 2, to form three display spaces S, each about 16 inches wide in lateral direction L and 12 inches deep in crosswise direction C.

Figure 4:
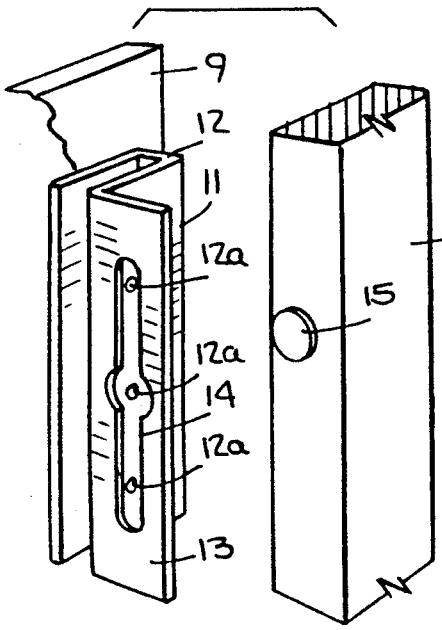
FIG. 4 a is an exploded perspective partial view of a connector for mounting a panel on the frame as shown in FIG. 3.

Panels 9 are removably mounted on frame 2 by three equally spaced connectors 11 per panel 9. Each connector 11 includes a clip 12, suitably fixed to the panel, e.g. by blind rivets in holes **12*a*, and having a vertical and laterally offset wind 13 with a keyhole slot 14, plus a separate stud 15 rigidly fixed to frame 2 and engageable in keyhole slot 14 (FIG. 4**).

Each panel 9 may thus be mounted on a given strut 3 with each keyhole slot 14 slidably received by its counterpart stud 15, keyhole slots 14 and studs 15 being arranged to mount each panel 9 in hanging cantilever manner on frame 2. The two inner panels 9 have rear edge upper and lower notches **9*a*, 9*b* to engage top and bottom beams 4,5 to overlap their rear edges with the adjacent sides of the two inner struts 3 (FIGS. 2 and 3**).

A plurality of crossbars 16, of matching longitudinal span size to the lateral direction L width of the associated display space S, i.e. the lateral distance between the adjacent panel pair forming that display space S, may be installed at right angles to adjacent panels 9 at an almost unlimited number of locations within each associated display space S, i.e. at almost any horizontal front to back location and at almost any vertical location within the display space volume, by mounting the crossbar ends on the facing sides 10 of a pair of adjacent panels 9 forming the display space S. Each crossbar 16 is thus available at each such location to mount merchandise display elements thereon in display space S, e.g. one or more peghooks 17, or where two crossbars 16 are used together they may mount a flat tray or shelf 18 or a box tray 19 (FIGS. 1 and 2).

Crossbars 16 may be arranged at various vertical levels between adjacent panels 9 in an almost infinitely adjustable array to mount peghooks 17 carrying a large number of small size merchandise items SI side by side with or without overlap, or a flat tray 18 carrying medium size merchandise items MI or large size merchandise items LI, or a box tray 19, e.g. forwardly and downwardly inclined so that its contents are presented in "cascaded" or "waterfall" display (FIGS. 1 and 2).

By arranging a number of crossbars 16 in vertical and back to front horizontal staggered overlapping relation, they may mount peghooks 17 in a "cascaded" or "waterfall" display, with a flat tray 18 located closely vertically thereto (FIG. 5).

By providing each crossbar 16 as a vertical flat linear strip, i.e. lying in a vertical plane with the strip axis extending horizontally, peghooks 17 may have a simple rear attachment portion, e.g. a cross slot **17*a*, for slide fit infinite lateral adjustment mounting on the crossbar, plus a, e.g. 4 to 6 inch long, cantilever shank 17*b*, with a front upturned tip or stop 17*c* to retain items SI, and an optional rear lock flange 17*d* for snap fit mounting on the crossbar, yet the crossbar will withstand the cantilever forces of a number of side by side peghooks thereon (FIG. 5). Peghooks 17 desirably may also have an upper front indicia portion or flag 17*e*** for carrying merchandising information.

The underside of flat tray 18 has front and rear lock flanges **18*a* for snap fit mounting on two spaced crossbars 16 (FIG. 5). Front corners 18*b* formed by front and rear lock flanges 18*a* with the tray underside act to seat the tray as a forwardly and downwardly inclined tray on two crossbars 16 at different heights, i.e. a rear crossbar at an upper level horizontally near frame 2 and a front crossbar at a lower level horizontally near the front of display space S (not shown). Front lip 18*c* retains the items when tray 18** is inclined.

Similarly, the underside of box tray 19 has front and rear lock flanges **19*a* for snap fit mounting on two spaced crossbars 16 (FIG. 6), and the corresponding front corners 19*b* act to seat the tray as an inclined tray on two crossbars at different heights in display space S (not shown). Front wall 19*c* similarly retains the items when tray 19** is inclined.

To enhance the structural rigidity of the cantilevered panels 9 on frame 2 and prevent relative lateral movement of the panels, a crossbar 16 may be mounted between each pair of adjacent panels near their front, and desirably also their rear, edges, e.g. near their top and/or bottom edges, to form a box-like reinforced structure. This may be combined with placing a flat tray 18 near the top of each display space S and/or a box tray 19 near its bottom, using a pair of front and back crossbars 16 as both tray supports and panel reinforcers.

Each panel 9 may have a separate top extension 20 (FIGS. 1 and 5), as where a flat tray 18 is located at the top of display space S. In this case, the panel top edge has a latch seat **9*c* formed of an upper plate 9*d* and lower aperture 9*e*, e.g. at three locations therealong to engage three matching sets of latch clips 20*a* on the top extension (FIGS. 1, 2, 5 and 7**).

Figure 7:
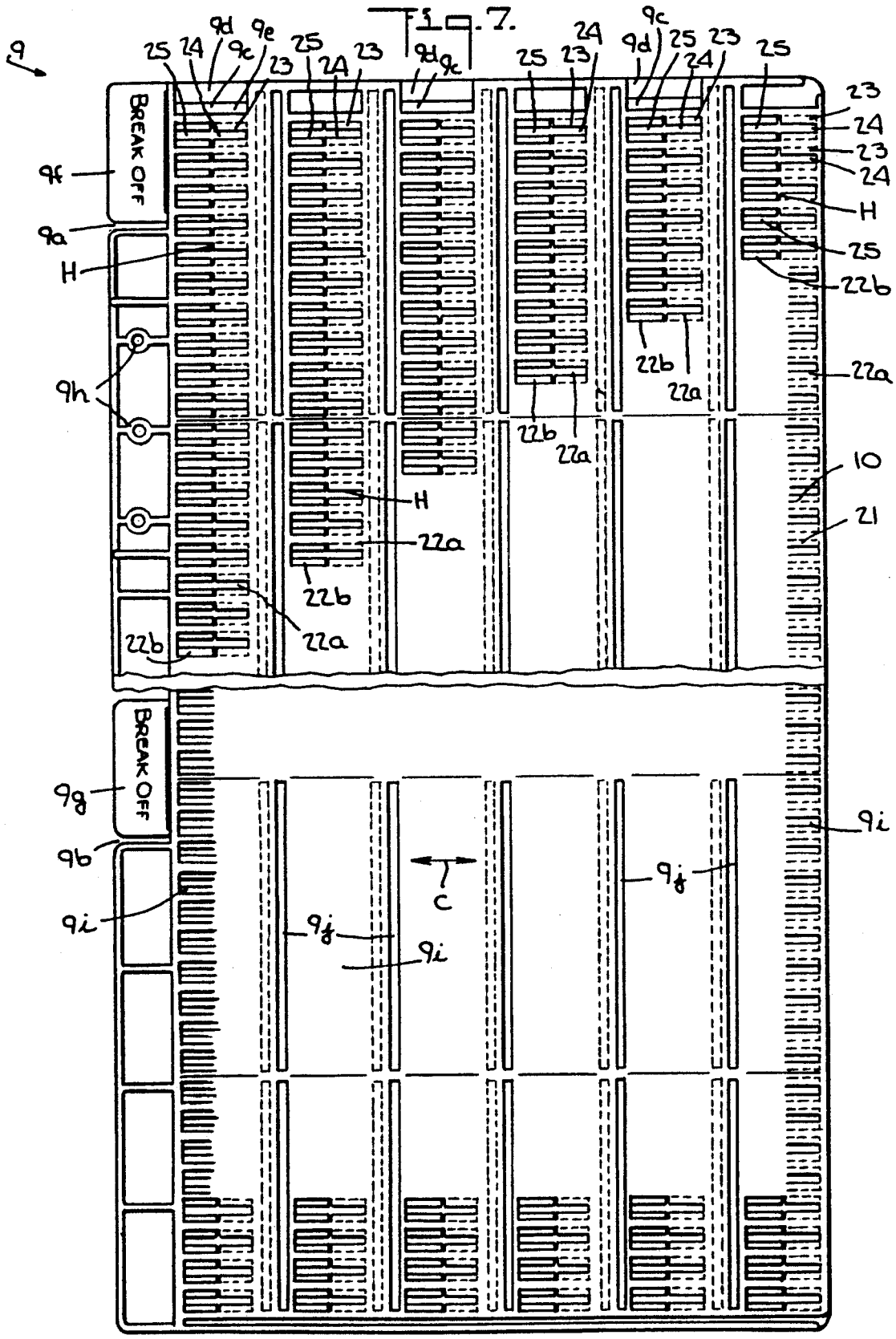
FIG. 7 is a elevational view of a panel side.

As shown in FIG. 7, each panel 9 is preferably modular, e.g. with break off fins **9*f*, 9*g* at notches 9*a*, 9*b* in its rear edge for simple snapping off on the inner panels 9 to prepare them for mounting on frame 2 (FIG. 3), and spaced sets of holes 9*h*** on their rear edge to mount clips 12, e.g. by blind rivets, to hang removably each panel on frame 2 via matching studs 15.

Each panel side 10 has vertical rows of horizontal cut out sections 9*i* and intervening vertical solid column sections 9*j*. Cut out sections 9*i* include an enlarged entrance slot portion communicating with an adjacent smaller captive locking slot portion that cooperate with a counterpart locking formation on the adjacent end of each crossbar 16 to mount the crossbar between adjacent panels 9 and interlock them against lateral movement. Column sections 9*j* furnish structural support to panels 9 to withstand the item load on crossbars 16.

As shown in FIGS. 7–12, each panel side 10 has cut out sections 9*i* arranged as a modular lattice 21 of a series of, e.g. six, side by side vertical rows 22 of horizontal tiers 23 of panel joint formations, such as laterally recessed female captive locking grooves 24, coacting with those of the facing side 10 of an adjacent panel 9, to form a plurality of facing cooperating pairs of such grooves 24 in display space S.

One side 10*a* of a panel 9 has rows 22*a* of tiers 23*a* of grooves 24*a*, and the opposite side 10*b* of the same panel has opposed rows 22*b* of tiers 23*b* of grooves 24*b*, with each row 22*a* offset in crosswise direction C from the opposed row 22*b* on the opposite side of the same panel, as well as zonally separated therefrom in lateral direction L by a slight gap G (FIGS. 8 and 10–12) and in crosswise direction C by a slight gap H (FIGS. 6, 8 and 10–12), the offset on the given panel side providing a lateral clearance recess 25 communicating with the adjacent groove 24 at that side and serving as an entrance thereto.

Each recess 25*a* on panel side 10*a* is in crosswise offset relation to its communicating groove 24*a* in its row 22*a* at its tier 23*a*, and correspondingly each recess 25*b* on opposite panel side 10*b* of the same panel is in crosswise offset relation to its communicating groove 24*b* in its row 22*b* at its tier 23*b*.

Specifically, in crosswise direction C each recess 25 corresponds to the enlarged slot portion and each groove 24 corresponds to the smaller slot portion of each cut out section 9*i* on the same panel side, but separated by gap H, while in lateral direction L, i.e. in the panel thickness direction, each recess 25*a* is adjacent the opposed groove 24*b* and each groove 24*a* is adjacent the opposed recess 25*b*, but correspondingly separated by gap G perpendicular to gap H.

As shown in FIGS. 8–13, each crossbar 16 is preferably a vertical strip, e.g. a strap or plate, with a smooth and even flat support span 30 and a pair of opposed vertical parallel right angle locking flanges 31,32 on its ends and forming a one-piece unitary structure therewith, flange 31 extending in one crosswise direction C away from the crossbar and flange 32 extending in the opposite crosswise direction C. Each flange 31,32 is square shaped and has a locking formation on its outer face forming a counterpart joint formation, e.g. a male locking tongue 33 mating with each groove 24.

Preferably, an end cap 34 is disposed on each flange 31,32 via a bore 35 conforming to the flange cross section, and having a corner recess 36 to accommodate the bend between span 30 and each flange 31,32. Burrs 37 may be located on the top and bottom edges of flanges 31,32 for tight grip fit between the respective end caps 34 and the square shaped flanges 31,32 (FIG. 13), whereby to provide each crossbar 16, and its flanges 31,32 and their end caps 34,34 as a composite one-piece unitary structure. In this case, the crossbar joint formations or tongues 33 are disposed on the outer faces of end caps 34.

Figure 9:
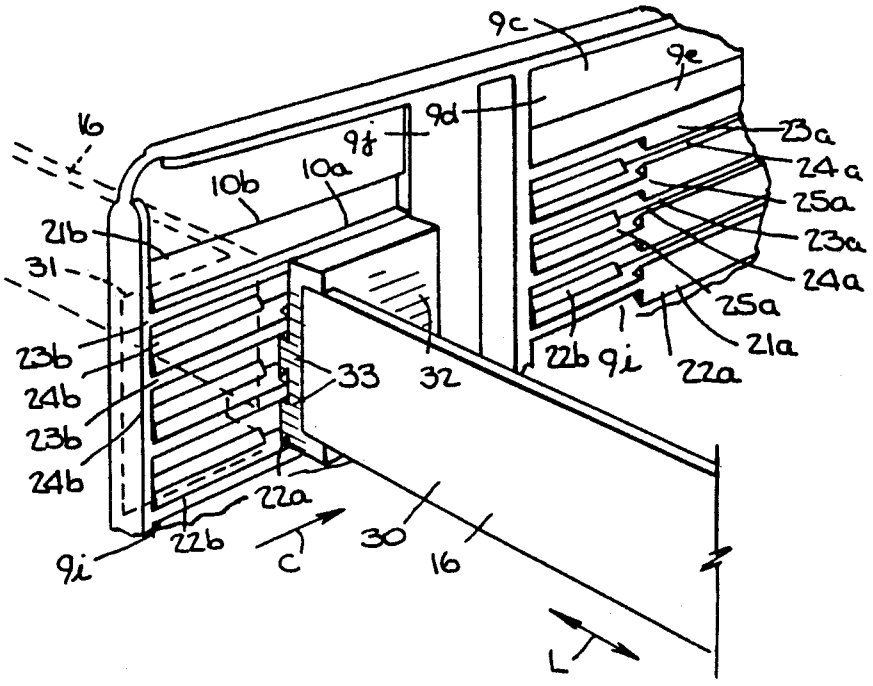
FIGS. 8 and 9 are schematic views showing the manner of attaching a crossbar between a pair of adjacent panels.
Figure 8:
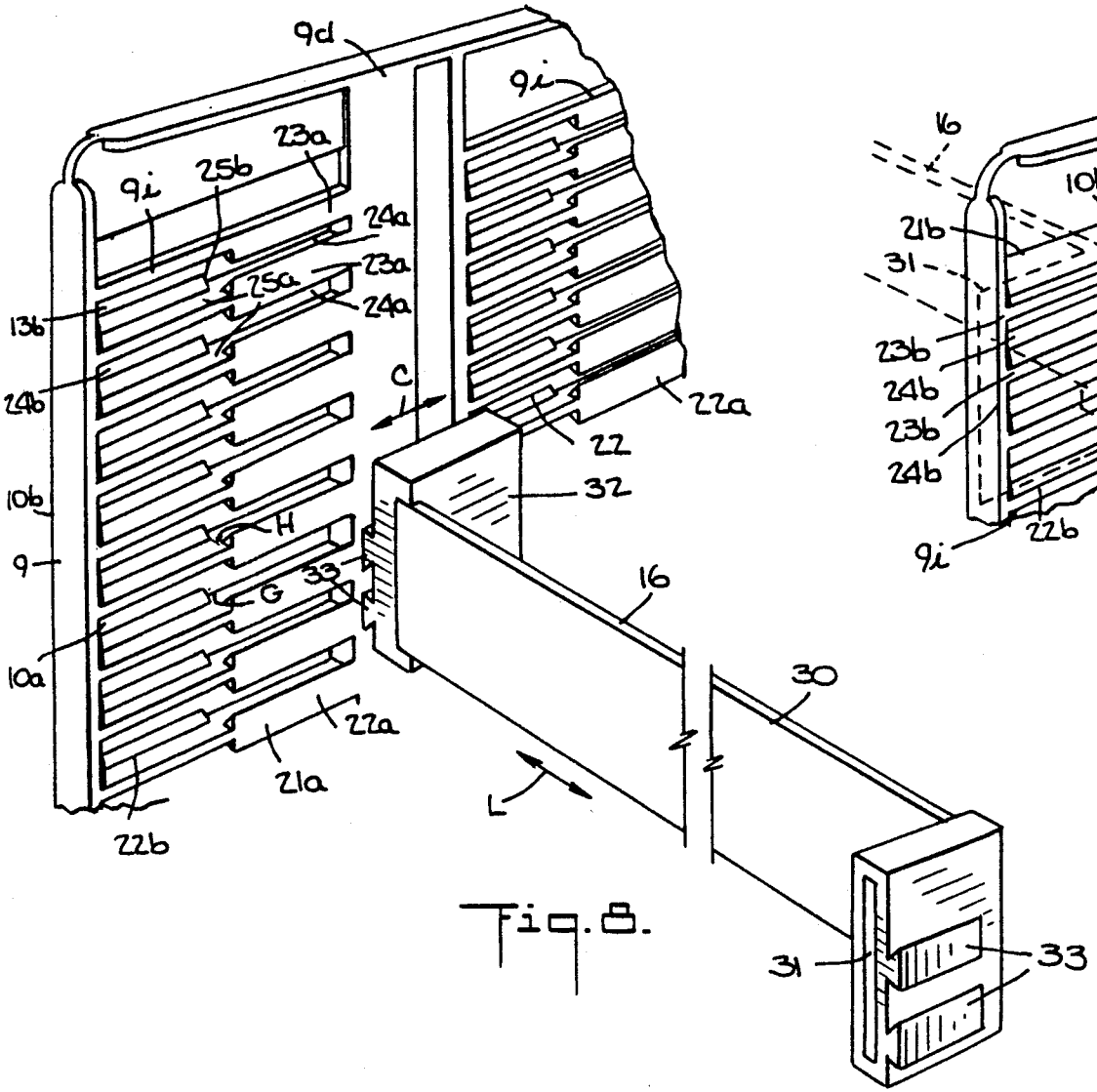

Male tongues 33 and female grooves 24 are desirably slide fit mating, such as dovetail, e.g. 45 degree angle, tongues and grooves, each crossbar formation being a set of two vertically stacked parallel horizontally extending locking tongues 33 and each panel formation being a set of two vertically stacked parallel horizontally extending locking grooves 24 (FIGS. 8–9).

Thus, each crossbar 16 has an opposed pair of male locking formations on its ends, each being a set of two tongues 33 on an end, mating with each facing cooperating pair of female locking formations, each being a set of two grooves 24 on each facing side 10 of a pair of adjacent panels 9, to form a pair of opposed locking joints to mount the crossbar between the panels at any facing cooperating pair of grooves 24 in display space S and to interlock such panels via the opposed joints.

Figures 10, 11, 12:
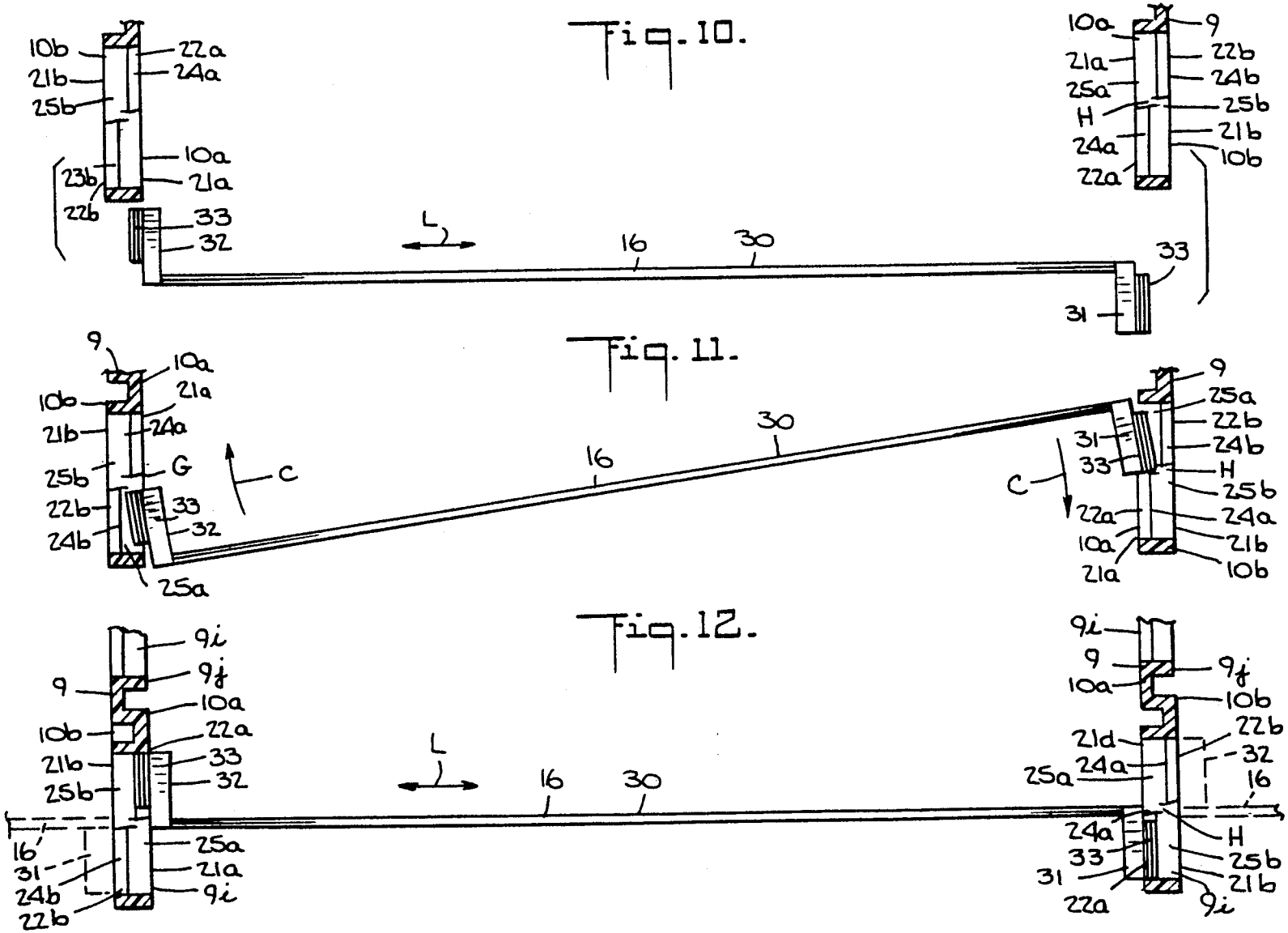
FIGS. 10 to 12 are schematic top views of the steps in achieving the attachement as shown in FIGS. 8 and 9.

It will be noted from FIGS. 10–12 that to mount a crossbar 16 between adjacent panels 9 to support its load of merchandise items, the crossbar ends, or more specifically the opposed pair of sets of tongues 33, must overlap in lateral direction L with the grooves 24 in the facing sides 10 of the two panels. Due to this overlap, recesses 25 are needed as they enable crossbar 16 to move to locking position by simply twisting in a horizontal plane in crosswise direction C, e.g. about a vertical axis.

This twisting moves one end of crossbar 16 toward frame 2 and the other end toward the front of display space S, permitting the tongues 33 on one end to enter a set of two vertically stacked parallel horizontally extending recesses 25 on one panel and slide into locking engagement with their adjacent grooves 24, and then the tongues 33 on the other end to enter the cooperating set of two vertically stacked parallel horizontally extending recesses 25 on the other panel and slide into locking engagement with their adjacent grooves 24.

By use of modular panels 9, one common to two display spaces S will have a lattice 21 of rows 22 of tiers 23 of grooves 24, usable in said sets, on each of its sides 10, with each row on one side offset in crosswise direction C to the same row on the opposite side, so that the grooves occupy essentially the panel thickness. The grooves in one side are immediately laterally adjacent and in horizontal alignment with, and concordantly offset in crosswise direction relative to, those respectively in the opposed side, separated by gap G.

This permits the coacting grooves 24 and tongues 33 to be arranged for in line lateral positioning of one crossbar 16 with the set of tongues 33 on one of its ends in locking engagement with a set of grooves 24*a* at a set of tiers 23*a* of a row 22*a* on one side 10*a* of a common panel 9 in one of the two adjacent display spaces S, and another crossbar 16 with the set of tongues 33 on one of its ends in locking engagement with the corresponding same opposed set of grooves 24*b* at the same opposed set of tiers 23*b* in the same opposed row 22*b* on the opposite side 10*b* of the same common panel 9 in the other of the two adjacent display spaces S (FIGS. 9 and 12).

Since the tongues 33 on crossbar 16 must overlap in lateral direction L with the grooves 24 on the facing sides 10 of a pair of adjacent panels 9 to provide the load bearing joints, and since the end of a crossbar 16 being installed on one side 10*a* of a common panel 9 must clear the opposing tongues 33 on the end of an already installed crossbar 16 on the opposite side 10*b* of the same panel, i.e. within the limits of gaps G and H (FIG. 10), flanges 31,32 must extend in opposite crosswise directions relative to crossbar 16 in S-shaped or Z-shaped profile, in order to negotiate via the facing recesses 25*a* on the facing sides 10*a* of the panels the confined path leading to the facing coacting grooves 24*a*.

If the flanges both extended in the same crosswise direction in U-shaped profile, the crossbar could not be twisted horizontally in unstressed condition to enable its tongues to enter the recesses, but instead would have to be unduly flexible to enable it to be bowed abnormally under unstable stressing for its tongues to clear the panel sides and reach the recesses, yet when so bowed its flanges would be at an angle to each other and out of alignment with the grooves. That extra flexibility would detract from the load bearing ability of the crossbar, and the U-shaped crossbar would be difficult if not impossible to install between the panels.

Of course, due to the desired flush parallel relation between panels 9 and flanges 31,32, and the overlap between tongues 33 and grooves 24, crossbar 16 cannot be twisted vertically to enable the tongues to enter the grooves.

In line with the above, it will be seen that panels 9 are not mirror images, but rather truly modular exact or identical duplicates. A row 23*a* on side 10*a* of each panel 9 is offset in crosswise direction C from the same row 23*b* on the opposite side 10*b* of the same panel, to permit arranging the panels in any order on frame 2, yet the tongues 33 on the opposed crosswise flanges 31,32 will always mate with the facing pair of sets of grooves 24*a* at the desired location in display space S, while the exposed sides of the end panels will present a pleasing lattice 21*b* of sections 9*i* and sections 9*j*.

Also, each groove 24*a* in the facing side 10*a* of one panel 9 is in offset relation in crosswise direction C to the cooperating groove 24*a* in the same tier 23*a* of the same row 22*a* in the facing side 10*a* of the other panel 9 of a pair, and each recess 25*a* is in offset relation in crosswise direction C to its associated groove 24*a* in a given side 10*a* and in direct alignment in lateral direction L with the cooperating groove 24*a* in the same tier 23*a* of the same row 22*a* in the facing side 10*a* of the other panel 9 of the pair (FIG. 12).

Thus, the modular lattice 21 on each side 10 of each panel 9 provides an orthogonal criss cross grid or array that permits any crossbar 16 to be placed at a more or less unlimited number of individual modular positions within a display space S, independently of the positioning of any crossbar 16 in an adjacent display space S, in terms of both the vertical direction and the front to back crosswise direction C, and by providing crossbars 16 with slide like spans 30 and peghooks 17 with coacting slide slots 17*a*, each crossbar 16 may carry a maximum number of peghooks 17 in infinitely adjustable individual side by side positions in lateral direction L.

This allows for a great variety of combinations of arrangements of crossbars 16 with peghooks 17, flat trays 18 and box trays 19, with such trays either disposed horizontally or at an incline, depending on the relative height location of the front and back pair of crossbars 16 supporting the tray. Use of an inclined tray enhances product visibility and consumer shopability, i.e. ease of access to the items, as certain product items are arranged in front of others for efficient use of the display space volume while still allowing the rear items to be sufficiently seen rather than hidden.

In fact, by staggering crossbars 16 in display space S to achieve an overlapping or "waterfall" effect of products on peghooks 17 and/or on trays 18 and 19, the quantity of product items that can be displayed in the display space volume may be increased significantly (FIG. 5). For example, using three 4 inch long peghooks 17, or two 6 inch long peghooks 17, in a crosswise direction C 12 inch depth display space S, in a typical staggered or "waterfall" configuration, presents roughly 30 to 50% more product in the display space volume than would a presentation on a known type flat pegboard unit.

This is because advantage may be taken of the vertical direction "stepped" overlap of the lower portion or hidden volume VH of the next rearward and upward set of small items SI on one "stepped" peghook 17 by the upper portion or exposed volume VE of the next forward and downward set of small items SI on the next forward and downward "stepped" peghook 17, while staggering the peghooks 17 so that there is no overlap in the horizontal or crosswise direction C (FIG. 5).

The exposed volume VE or upper portion of the set of small items SI on each upper peghook 17, i.e. behind the forwardmost and lowermost fully exposed item containing peghook 17, is sufficiently visible for consumer recognition and access, permitting the hidden volume VH or lower portion of its set of small items SI to be compactly arranged behind the next forward and downward peghook set of small items SI, to use the volume of the given display space S most efficiently, without sacrificing consumer recognition and access. In short, the full horizontal depth in crosswise direction C can be occupied by the small items SI without overlap or interference therebetween, by "stepping" the peghooks 17 and their carried small items SI acceptably in partially vertically overlapping height.

Figure 15:
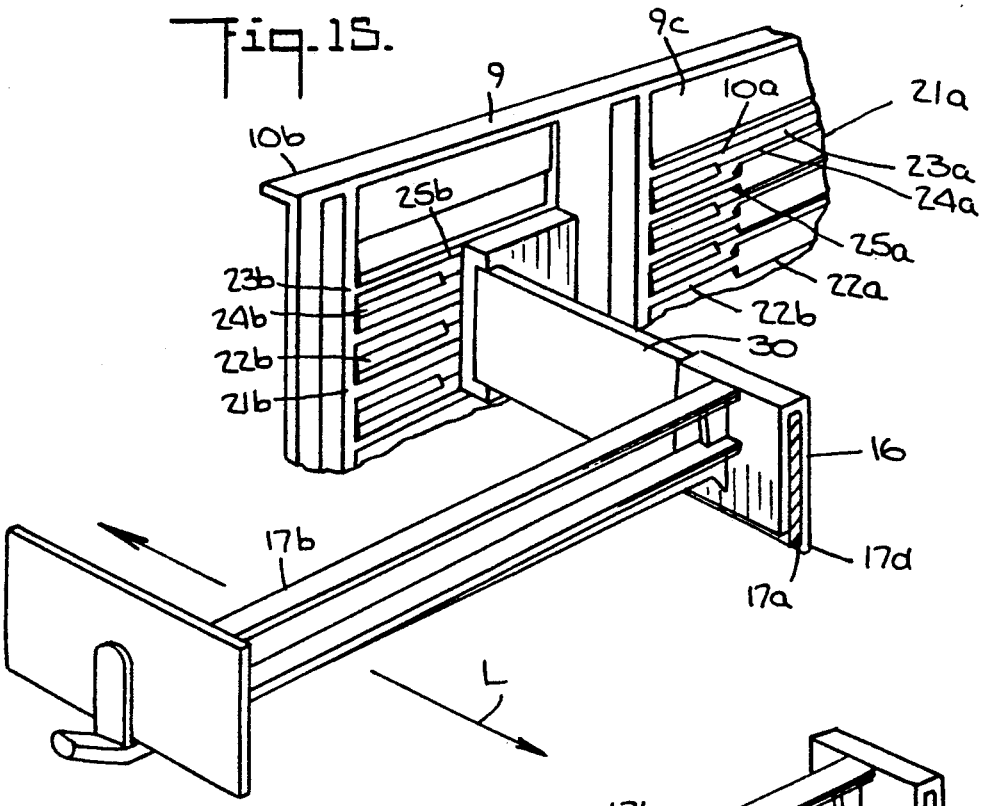
FIGS. 14 and 15 are perspective views of a merchandise display element peghook and its positioning on a crossbar.
Figure 14:
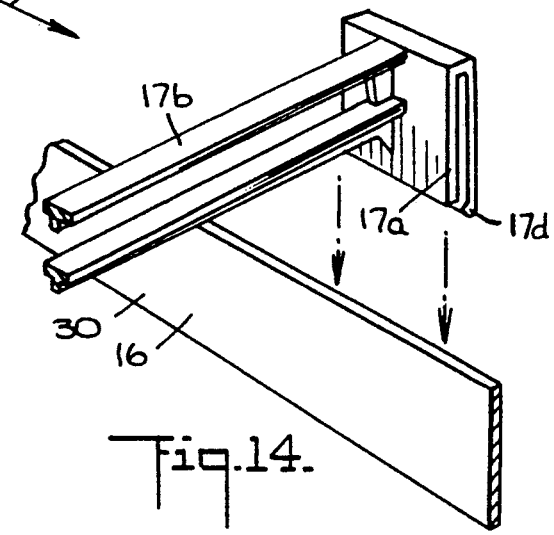
Figure 13:
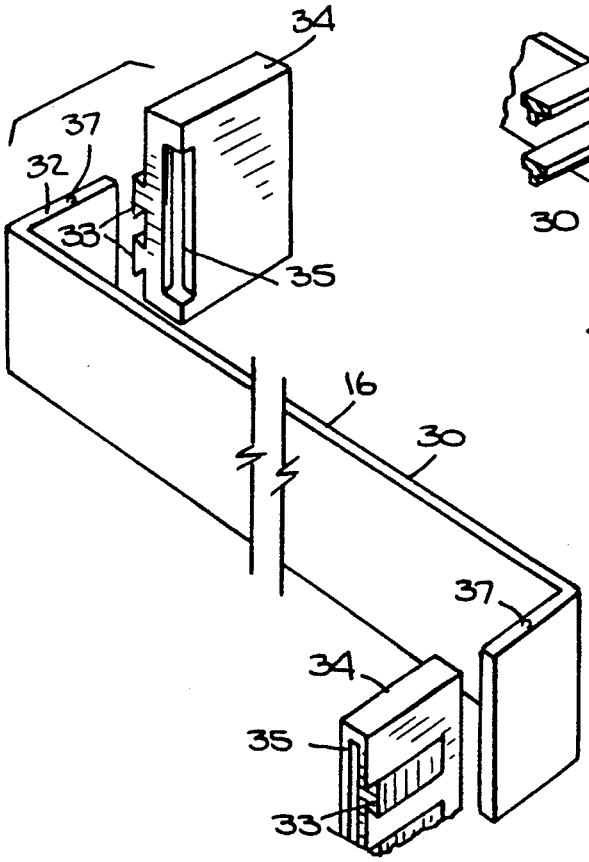
FIG. 13 is an exploded perspective view of a crossbar.

It is clear from FIGS. 2, 5 and 13–15, that by providing crossbars 16 with flanges 31,32 carrying tongues 33 on their outermost smooth faces, and panels 9 with smooth sides 10 containing recessed grooves 24 interlocking with tongues 33, the weight of merchandise items on cantilever peghooks 17 of a crossbar 16 is readily transmitted to the adjacent panels 9, with the torque being resisted by the right angle flanges 31,32 as squares at each crossbar end in flush relation to the panel sides 10, e.g. being resisted upwardly by rearward flange 32 and downwardly by forward flange 31 (FIGS. 12 and 15).

Also, by providing crossbar 16 as a vertical strap or plate, the load of carried items is supported in stable manner without sagging in the middle of spans 30 as tends to occur with round rod or wire members as used in known pegboard units.

Unit 1 is favorably composed a metal frame 2, e.g. of welded steel tubing parts, metal crossbars 16, e.g. of steel strap or plate material, molded plastic end caps 34, and plastic panels 9, e.g. each as a one piece molded structure.

Because of the specific configuration of grooves 24 and recesses 25 on each side 10 of a panel 9 at each common tier 23 of each common row 22, and the need for only a slight gap G, panels 9 may be made with a very thin thickness.

For example, panel 9 may have a thickness of only about 0.3125 (5/16) inch, composed of a dovetail groove thickness on each side 10 of about 0.106 inch separated by a gap G of about 0.1005 inch, and a front to back or crosswise length of about 12–12.5 inches with six cut out sections 9i and associated column sections 9j, each set of a section 9i and a section 9j having a horizontal length in direction C of about 2 inches.

Each set of a cut out section 9i and a column section 9j may have a vertical row 22 with a recess 25 about 0.625 (⅝) inch long and a groove 24 about 0.625 (⅝) inch long, the groove 24a on one side 10a being separated in crosswise direction C from the groove 24b on the opposite side 10b by a gap H of about 0.0625 (1/16) inch, and an adjacent column section 9j of a length of about 0.6875 (11/16) inch. The height interval between tiers 23 may be about 0.500 (½) inch.

Hence, crossbars 16 may be positioned at 2 inch front to back crosswise horizontal intervals and at 0.500 (½) inch up and down vertical intervals in display space S (FIG. 5).

Of course, crossbars 16 are provided with tongues 33 on end caps 34 of mating dimensions to grooves 24 for precise slide fit interlocking therewith, e.g. with each set of tongues projecting about 0.109 inch from the end cap 34 surface and with their horizontal center lines spaced vertically from each other about 0.500 (½) inch to provide a vertical gap of about 0.157 inch between their facing outer parallel edges to engage matching portions of the corresponding set of grooves 24.

Thus, when a set of tongues 33 on a crossbar 16 is engaged with a set of grooves 24a on one panel side 10a, the tongues 33 will be spaced, e.g. about 0.0945 inch (within gap G), in the panel thickness direction from the offset set of tongues 33 on a separate crossbar 16 in the adjacent display space S engaged with the opposed set of grooves 24b on the opposite side 10b of the same panel 9, so that the two crossbars in line in adjacent display spaces S will not overlap. Each crossbar may be a metal strap of about 14 gauge thickness, 1 inch height, 15.3125 (15 5/16) inch length (i.e. for a 16 inch wide display space S, and like spacing of the associated struts 3 and panels 9) or 19.125 (19⅛) inch length (i.e. for a 20 inch wide display space S, and like spacing of the associated struts 3 and panels 9), and 0.750 (¾) inch long flanges.

It will be noted that for 0.3125 inch thick panels 9, a 16 inch lateral direction L display space S width between adjacent panels will actually amount to about 15.5 inches, and a 20 inch lateral direction L display space S width between such panels will actually amount to about 19.3125 (19 5/16) inches, and that the difference between such dimensions and those of the crossbar length is made up by the thickness dimensions of the opposed outside walls of the end caps 34 on the opposed end flanges 31,32 (FIGS. 8, 9 and 13), e.g. each wall being about 0.09375 (3/32) inch thick and both collectively about 0.1875 (3/16) inch thick.

Hence, the given composite longitudinal length of the crossbar in lateral direction L from one outside end cap wall to the other will be about 15.5 inches (15.3125+0.1875) or 19.3125 inches (19.125+0.1875), as the case may be, and thus precisely matching the associated display space S lateral direction L width between adjacent panels 9. Since tongues 33 lie outwardly of the outside walls of the end caps, they necessarily overlap with the grooves 24 for a matching set of a given crossbar and associated pair of adjacent panels. Of course, trays 18 and 19 will be comparably sized to the associated crossbars 16 in lateral direction L width.

Unit 1 may be shipped in knocked down form and readily assembled on site by unskilled workers using wing nuts and/or thumbscrews, without special tools, and readily disassembled as well. Initially, clips 12 will be connected to all panels 9, and once frame 2 is erected at the site, fins 9f, 9g may be snapped off from inner panels 9, and all the panels then slid via keyhole slots 14 onto studs 15 to hang them on the frame. Installing front and rear crossbars 16 near the top and bottom edges of all adjacent panels 9, i.e. in line with each other in adjacent display spaces S, forms a stable orthogonal self-bracing box-like unit.

The present invention thus provides a merchandise display unit permitting more efficient use of the available display area in a compact manner while avoiding structural failure as might occur under a high load of merchandise items suspended from cantilever peghooks mounted on a known type pegboard unit.

It will be appreciated that the foregoing specification and accompanying drawings are set forth by way of illustration and not limitation, and that various modifications and changes may be made therein without departing from the spirit and scope of the present invention which is to be limited solely by the scope of the appended claims.

What is claimed is:

1. Merchandise display unit, comprising an arrangement of a plurality of generally vertical parallel panels in side by side facing relation along a lateral display area, such that the panels extend crosswise thereof and the facing sides of a given pair of adjacent panels define a given display space therebetween, each facing side having a modular lattice of side by side generally vertical rows of horizontal tiers of panel joint formations correspondingly arranged for coaction with those of the lattice of the other facing side to form a plurality of facing cooperating pairs of panel joint formations in the display space, and at least one crossbar for mounting one or more merchandise display elements thereon in the given display space, the crossbar having opposed ends provided with a pair of opposed generally vertical parallel flanges, one flange extending on one crosswise direction away from the crossbar and the other flange extending in the opposite crosswise direction away from the crossbar and an opposed pair of counterpart crossbar joint formations located repsectively on the outermost faces of the flanges and forming a composite unitary structure with the crossbar and flanges, the opposed pair of counterpart crossbar joint formations overlapping laterally with and mating with each facing cooperating pair of panel joint formations and forming a pair of opposed locking joints therewith, to mount removably the crossbar between the given pair of adjacent panels at the location of any facing cooperating pair of panel joint formations thereon in the display space and to interlock laterally said pair of panels via the opposed joints in response to the crossbar being rotated angularly about a generally vertical axis between the panels from a position in which its flanges are at an angle to the panels to a position in which the outermost faces of the flanges are in close generally parallel relationship to the panels to move the crossbar joint formation on its one end face into locking engagement with a panel joint formation on one panel and to move the crossbar joint formation on its other end face into locking engagement with the cooperating panel joint formation forming the respective cooperating pair therewith on the other panel.

2. Unit of claim 1 wherein a plurality of crossbars is provided, each in the form of a generally vertical strip having said pair of opposed generally vertical parallel flanges on the ends thereof and said opposed pair of crossbar joint formations located on the outermost faces of the flanges and forming said unitary structure with the crossbar and flanges.

3. Unit of claim 2 wherein each flange has an end cap thereon and the crossbar joint formations are disposed on the end caps.

4. Unit of claim 2 wherein the crossbar joint formations and panel joint formations include mating tongues and grooves.

5. Unit of claim 4 wherein the formations include mating dovetail tongues and grooves.

6. Unit of claim 4 wherein the panel joint formations include grooves recessed laterally in the facing sides of the given pair of adjacent panels, such that each groove in the facing side of one panel is in offset relation in a crosswise direction to the lateral direction of the display area to the corresponding cooperating groove in the same tier of the same row in the facing side of the other panel, the crossbar joint formations include tongues which overlaps laterally with said grooves, and a lateral clearance recess is located in the facing side of each corresponding panel in offset relation in said crosswise direction to each groove on that side and in alignment in said lateral direction with the corresponding cooperating groove in the same tier of the same row in the facing side of the other panel, to permit movement of the corresponding crossbar tongues in relative crosswise direction to make the tongues with the corresponding facing cooperating pair of panel grooves to form said opposed joints.

7. Unit of claim 6 wherein at least three panels are provided, and one panel is common to two adjacent display spaces and has a said lattice of vertical rows of horizontal tiers of said grooves in each of its opposed sides, each row on one side being offset in crosswise direction relative to the same corresponding row on the opposed side, such that the grooves occupy substantially completely the thickness of such common panel with the grooves in one side being immediately laterally adjacent and in horizontal alignment with, and concordantly offset in crosswise direction relative to, the corresponding opposed grooves respectively in the opposed side, and the grooves and tongues are arranged to permit in line lateral positioning of one crossbar with its tongues in one facing cooperating pair of panel grooves at a given tier of one corresponding row of a given pair of adjacent panels, including said common panel, in one of said two adjacent display spaces, and another crossbar with its tongues in the same corresponding facing cooperating pair of panel grooves at the same tier in the same row of the next adjacent pair of adjacent panels, including said some corresponding but offset row in said common panel, in the other of the two adjacent display spaces.

8. Unit of claim 1 wherein a generally vertical laterally extending frame is disposed along the display area, and connectors are provided to mount removably the panels on the frame in said arrangement.

9. Unit of claim 8 wherein each connector includes a keyhole slot and a separate cooperating stud engageable in the keyhole slot, one of which is located on the corresponding panel and the other of which is located on the frame, the keyhole slot and stud being arranged to mount such panel in hanging cantilever manner on the frame.

10. Unit of claim 9 wherein the connector includes a clip mounted on the corresponding panel and having a generally vertical and laterally offset wing containing the keyhole slot, and the stud is rigidly mounted on the frame for receiving the keyhole slot.

11. Unit of claim 1 wherein a plurality of crossbars and a plurality of merchandise display elements are provided, the display elements being mountable on the crossbars.

12. Unit of claim 11 wherein the display elements include peghook elements, each having an attachment portion to attach the element to a corresponding crossbar.

13. Unit of claim 11 wherein the display elements include at least one tray element.

14. Unit of claim 1 wherein the panel is a one piece plastic structure.

15. Bilateral locking joint unit comprising a pair of generally parallel panels having facing sides, each with a linear course of spaced apart panel joint formations facing the course of the other panel such that relative to a lateral plane intersecting the panels along their facing courses, the formations of one course in one panel extend in one offset crosswise direction away from the plane, and those of the other course in the other panel extend in the opposite offset crosswise direction away from the plane, to form respective offset cooperating pairs of facing panel joint formations, a crossbar sized to extend between and interlock the panels at any said cooperating pair of panel formations, and having a lateral span with opposed ends terminating in an offset pair of generally parallel end faces, such that one end face extends in one offset crosswise direction away from the span and is alignable with one course of panel formations on one panel in close generally parallel relation to the panel side thereat, and the other end face extends in the opposite offset crosswise direction away from the span and is alignable with the other course of panel foramtions on the other panel in close generally parallel relation to the panel side thereat, the pair of end faces having a counterpart offset pair of crossbar joint formations to interlock with a respective said cooperating pair of panel formations, such that the crossbar formations overlap with the adjacent panel formations when the crossbar extends between the panels, the crossbar formations forming a composite unitary structure with the crossbar and end faces, and a recess adjacent each panel joint formation to permit the crossbar to be moved angularly between the panels from a position in which its span is at an angle to such lateral plane to a position in which the span is generally parallel thereto to move the crossbar joint formation on its one end face into locking engagement with a panel joint formation on one panel via its adjacent recess, and the crossbar joint formation on its other end face into locking engagement with the cooperating panel joint formation forming the respective offset pair therewith on the other panel via its adjacent recess, to form a locking joint between the crossbar joint formation on each end of the crossbar and the facing panel joint formation thereat.

16. Unit of claim 15 wherein the crossbar end faces comprise an offset pair of generally parallel flanges.

17. Unit of claim 15 wherein the courses are generally vertical rows of generally horizontal tiers.

18. Unit of claim 15 wherein the courses include a series of side by side generally vertical rows of horizontal tiers of panel joint formations on each facing side.

19. Unit of claim 15 wherein each panel formation and adjacent recess comprise an enlarged entrance slot communicating with an adjacent smaller captive locking slot.

20. Unit of claim 19 wherein each locking slot comprises a female groove and each crossbar joint formation comprises a male tongue slidably lockable in the groove.

21. Merchandise display unit, comprising an arrangement of a plurality of generally vertical parallel panels in side by side facing relation along a lateral display area, such that the panels extend crosswise thereof and the facing sides of a given pair of adjacent panels define a given display space therebetween, each facing side having a modular lattice of side by side generally vertical rows of horizontal tiers of panel joint formations correspondingly arranged for coaction with those of the lattice of the other facing side to form a plurality of facing cooperating pairs of panel joint formations in the display space, and a crossbar sized to extend between and interlock the panels at any said cooperating pair of panel joint formations, the crossbar having a lateral span with opposed ends provided with a pair of opposed generally vertical parallel flanges, one flange extending in one crosswise direction away from the crossbar and the other flange extending in the opposite crosswise direction away from the crossbar and an opposed pair of counterpart crossbar joint formations located respectively on the outermost faces of the flanges and forming a composite unitary structure with the crossbar and flanges, the lateral distance between the outermost faces of the flanges generally corresponding to the lateral distance between the facing sides of the pair of facing panels, and the opposed pair of counterpart crossbar joint formations overlapping laterally with and mating with each facing cooperating pair of panel joint formations and forming a pair of opposed locking joints therewith, when the crossbar extends between the panels, and a recess adjacent each panel joint formation to permit the crossbar to be rotated in a generally horizontal plane, angularly between the panels from a position in which its flanges are at an angle to the panels to a position in which the outermost faces of the flanges are in close generally parallel relationship to the panels to move the crossbar joint formation on its one end face into locking engagement with a panel joint formation on one panel via its adjacent recess, and to move the crossbar joint formation on its other end face into locking engagement with the cooperating panel joint formation forming the respective cooperating pair therewith on the other panel via its adjacent recess, to form a locking joint between the crossbar joint formation on each end of the crossbar and the facing panel joint formation thereat.

22. The unit of claim 21 wherein the panel joint formations comprise cavities in the respective panel face, and the crossbar joint formations comprise protrusions extending outwardly of the respective outermost faces of the flanges.

23. The unit of claim 21 wherein the facing cooperating pairs of panel joint formations are arranged such that relative to a lateral, generally vertical, plane intersecting the pair of facing panels, one panel joint formation of a cooperating pair thereof extends on one panel in one offset crosswise direction away from the plane, and the other panel joint formation of said cooperating pair extends on the other panel in the opposite offset crosswise direction away from the panel, to form respective offset cooperating pairs of facing panel joint formations, and the crossbar is arranged such that its one flange is aligned for registry with said one panel joint formation of a cooperating pair and its other flange is algined for registry with said other panel joint formation of said cooperating pair, when the crossbar extends betwen the panels, for forming a pair of opposed correspondingly offset locking joints.

24. The unit of claim 23 wherein the panel joint formations comprise cavities in the respective panel face, and the crossbar joint formations comprise protrusions extending outwardly of the respective outermost faces of the flanges.

* * * * *